United States Patent [19]

Stephens

[11] Patent Number: 4,585,166

[45] Date of Patent: Apr. 29, 1986

[54] COLLAPSIBLE TOY AUTOMOBILE RACE COURSE

[75] Inventor: William F. Stephens, Hicksville, N.Y.

[73] Assignee: Mattel, Inc., Hawthorne, Calif.

[21] Appl. No.: 664,626

[22] Filed: Oct. 25, 1984

[51] Int. Cl.[4] ..... A63H 18/02

[52] U.S. Cl. ..... 238/10 R; 238/10 F; 446/168

[58] Field of Search ..... 238/1, 10 R, 10 A, 10 E, 238/10 F; 104/53, 54, 56; 446/168, 171, 173, 174, 444, 487; 273/86 C; 272/56.5 R

[56] References Cited

U.S. PATENT DOCUMENTS

| | | | |
|---|---|---|---|
| 2,992,598 | 7/1962 | Einfalt | 238/10 E X |
| 3,703,989 | 11/1972 | Tomiyama | 238/10 E |
| 3,726,476 | 4/1973 | Porter et al. | 238/10 E |
| 4,140,276 | 2/1979 | Halford | 238/10 R |
| 4,449,665 | 5/1984 | Goldfarb et al. | 238/10 R |
| 4,521,206 | 6/1985 | Saffer et al. | 238/10 R X |

*Primary Examiner*—Randolph A. Reese

*Attorney, Agent, or Firm*—Ronald M. Goldman; Melvin A. Klein

[57] ABSTRACT

A collapsible toy automobile race course having a spiral track with an arrangement for biasing the track to act as a spring having a relaxed essentially collapsed position and an extended taut position, and a post for holding the track in an extended position so that one end of the track is higher than the other end, and an arrangement for reversing the direction of an automobile traveling thereon at one end of the track.

5 Claims, 4 Drawing Figures

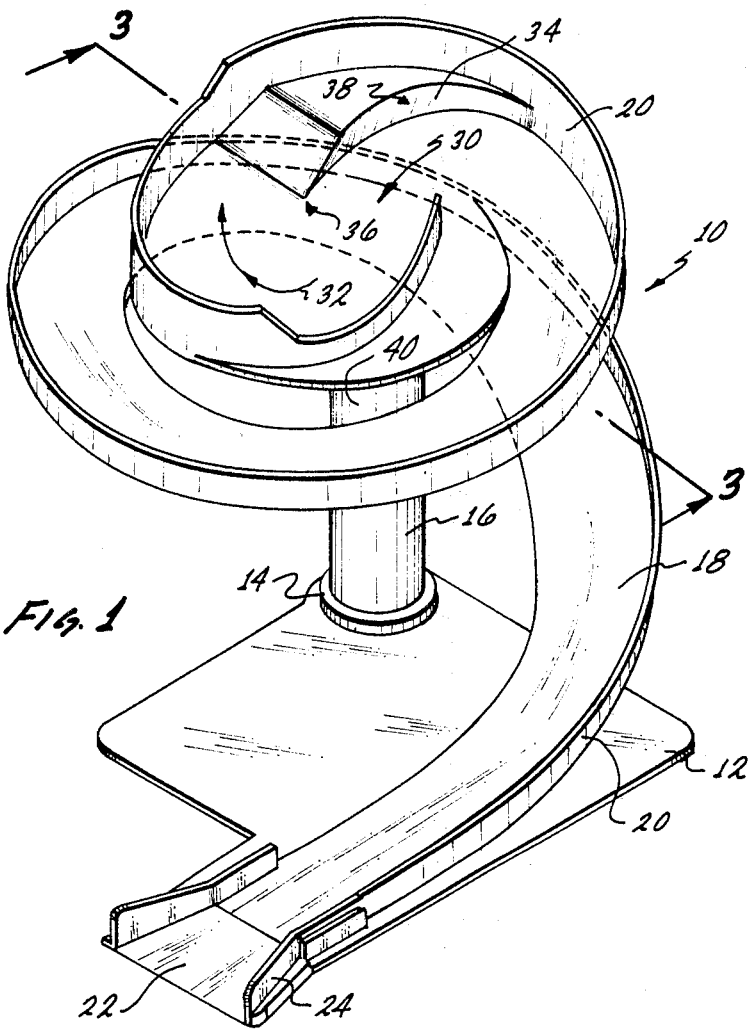
Fig. 1
Fig. 4
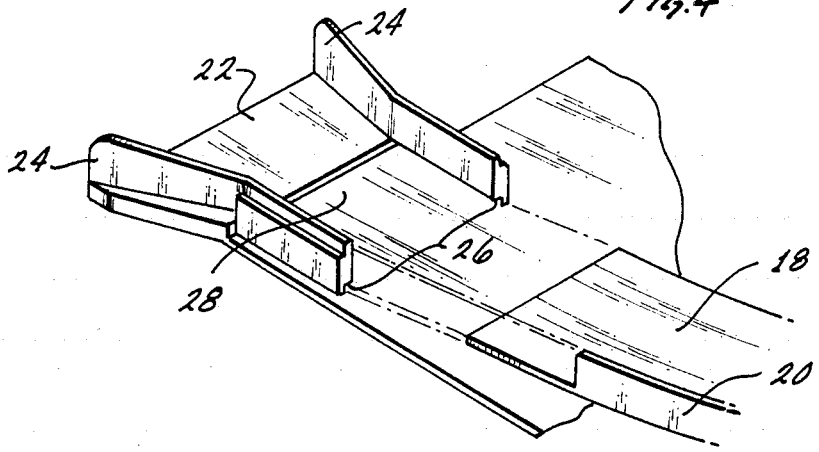

COLLAPSIBLE TOY AUTOMOBILE RACE COURSE

BACKGROUND OF THE INVENTION

This invention relates to toy automobile racing sets and, more particularly, to collapsible toy auto racing courses.

There have been many toy auto racing courses devised over the years upon which various toy automobiles may be raced. Most such courses take up a good deal of space and require a great deal of effort to both set up and put away.

It is an object of the present invention to provide a toy automobile racing course which is compact both when set up and when disassembled.

It is another object of the present invention to provide a toy automobile racing course which is extremely easy to set up and disassemble.

It is an additional object of the present invention to provide a toy automobile racing course which uses approximately one-half the space normally used by courses having similar lengths.

SUMMARY OF THE INVENTION

These and other objects of the invention are accomplished by a toy automobile racing course which includes a spirally wound racing track having a reversing turn at the innermost, uppermost portion of the spiral so that after a automobile has traversed the spiral in a first direction, it reverses its direction and repeats the spiral in the opposite direction thereby describing a path of twice the normal length. The course utilizes a single column for holding the center of the spiral track at a distance above a base piece. By placing the column between the base and center of the spiral track and inserting the lower end of the spiral track into slots in the base piece, the racing course is assembled. The course is disassembled by removing the column from its position supporting the interior of the spiral.

The invention will be more thoroughly appreciated by referring to the detailed specification which follows and the drawings in which like reference numerals designate like elements throughout the several views.

BRIEF DESCRIPTION OF THE DRAWINGS

FIG. 1 is a perspective view of an auto racing course constructed in accordance with the invention;

FIG. 4 is a detail of the course shown in FIG. 1.

DESCRIPTION OF THE PREFERRED EMBODIMENT

Figure 2:
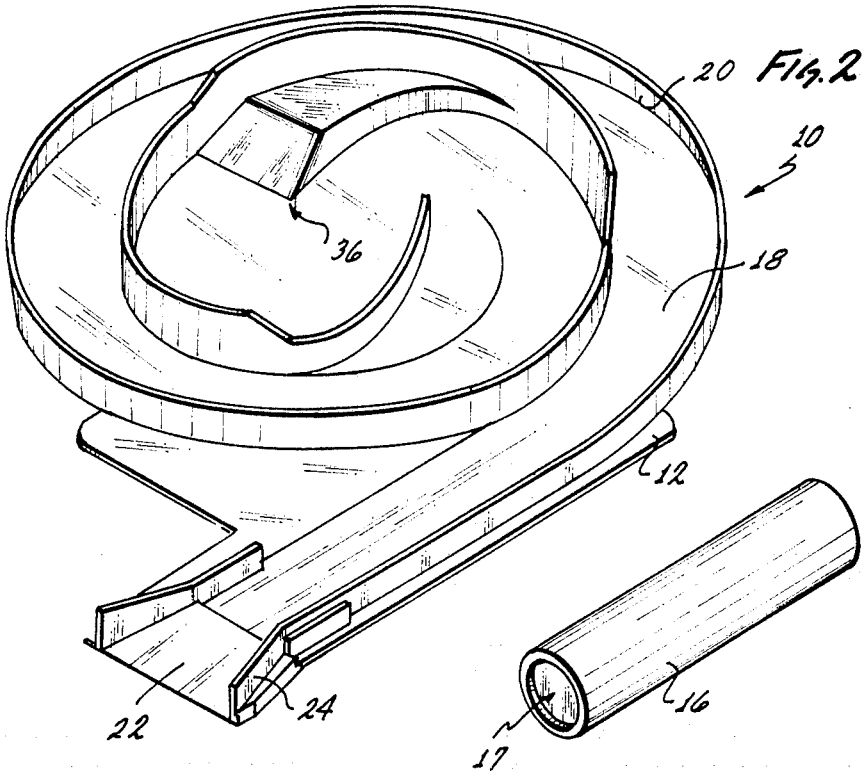
FIG. 2 is a perspective view of the auto racing course shown in FIG. 1 partially collapsed toward a position in which it may be carried.

FIG. 1 is a perspective view of a toy racing course 10. The course 10 includes a base portion 12 which mounts a receptacle 14 that supports a post 16 which itself supports the innermost portion of a spiral raceway track 18. The upper end of the post 16 (see FIG. 2) is relieved to match a depending projection 19 on the underside of the track 18 (see FIG. 3). The outer edge of the spiral track 18 supports a fence 20 which lends both support and rigidity to the track 18 and keeps toy autombiles used with the course 10 from leaving the track 18.

The track 18 at its lower end fits with an extending track portion 22 connected as a part of the base 12. The portion 22 is paralleled by a pair of walls or fences 24, one of which acts as an extension of the fence 20. The lower end of the track 18 fits into slots 26 in the fences 24 and is held in place thereby.

It should be noted that the fence 20 by meeting the track 18 at a right angle provides a means for biasing the track 18 to act as a spring. The spring formed by the track 18 and the fence 20 has a relaxed essentially collapsed position and an extended taut position. When the track 18 is placed in the extended taut position and held there by the post 16 so that one end of the track 18 is held higher than the other end, the track 18 descends uniformly from the one end to the other end. This arrangement allows the material of which the course 10 is constructed to be of an entirely different characteristic than would normally be utilized in constructing what is essentially a spring.

For example, the toy auto racing course 10 shown in FIG. 1 may be constructed of an injection molded plastic material; such materials are well known to those skilled in the art, but would not normally be used in the contruction of a track the shape of which depended upon its spring characteristics.

The base 12 may be molded separately from like material and have an extension 22 with a pair of walls 24 protruding upwardly. Each of the walls 24 has a groove 26 molded into the lower extremity of its inner surface which is adapted to receive an end 28 of the track 18. The end of the track 18 slides into the grooves 26 to fix the outer end portion of the track 18. The receptacle 14 in the base 12 firmly fixes the post 16 and the post 16 fixes the innermost portion of the track 18.

As may be seen in FIG. 1, the track 18 extends upwardly through two complete turns in an essentially linear spiral, supported along the way by the fence 20. It should be noted that the inclusion of the fence 20 along a single side of the track 18 provides sufficient support so that the track 18 maintains its shape without drooping even though relatively heavy toy automobiles may be utilized with the course 10.

After completing two turns, the track 18 is connected to an arrangement for reversing the direction of a toy vehicle traveling thereon. This arrangement could also be positioned at the outer end of the spiral or at both ends. The position of the reversing arrangement depends to a great extent on whether the vehicles are powered or not. Furthermore, maintaining the outer end of the spiral at a higher position than the inner end requires a more complicated arrangement for holding the two ends at different heights; and, consequently, the present arrangement is preferred.

The means positioned at the upper end of the track 18 for reversing the direction of a toy vehicle traveling on the track 18 includes an end section of track formed into a tear-drop shape surrounded by the first fence or wall 20. A second fence or wall 34 extends from the first fence 20 for diverting a vehicle to one side of the end section to cause such a vehicle to travel along the first fence 20. The end section of track 18 has a gradually inclined portion positioned so that a vehicle traveling along the first fence 20 is brought to a level such that it passes over the second fence 34.

Thus, a vehicle traveling up the track 18 turns sharply to the left at a first arrow 30 and then sharply back to the right at a second arrow 32. Any toy automobile ascending the track 18 is forced sharply to the left at the arrow 30 by the low fence 34 which projects inwardly from the fence 20 and contains such a toy automobile in a sharp left turn. The fence 34 terminates at a point 36 while the track 18 continues in a sharp right bend tending upwardly at the arrow 32. Such a toy automobile proceeds along the upward incline from the arrow 32 to an arrow 38 at which it leaps over the fence 34 and proceeds back down the track 18. During the period in which such a toy automobile is traversing the arrows 30, 32, and 38, it is constrained by the upper end of the fence 20 in a tight, first left, then right reversal.

As may be noted from FIG. 1, an opening 40 runs along the inside of the track 18 and one edge of the opening 40 constrains the toy automobile to remain on the track 18 in its downward path along the race course 10.

FIG. 2 illustrates the course 10 collapsing into a position in which all portions of the spiral race track 18 will lie on essentially the same level, i.e., the level of the base portion 12. In this collapsed position, the course 10 may be easily carried from place to place and takes up very little space.

Figure 3:
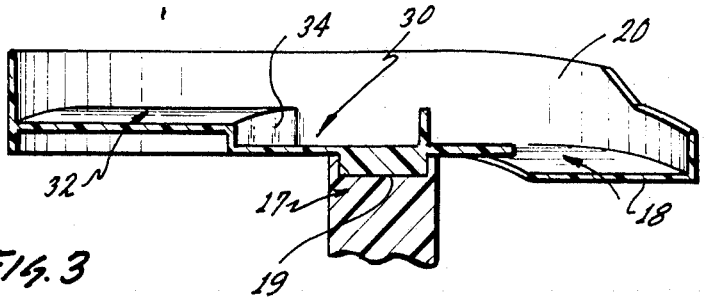
FIG. 3 is a cutaway side-view of a reversing turn at the innermost position on the spiral of the auto racing course shown in FIG. 1.

FIG. 3 is a cross-sectional view taken along the line 3—3 of FIG. 1 which illustrates the various elevations involved in the construction of the reversing turn at the top of the raceway 18. As may be seen, the turn at the arrow 30 progresses upwardly while the automobile is constrained by first the fence 20 and then by the fence 34 which branches therefrom. The automobile continues upwardly and reaches the position of the arrow 32 still heading upwardly. A toy automobile traversing the spiral track 18 leaps the fence 34 and begins to descend the raceway 18 being constrained by the fence 20.

FIG. 4 illustrates the connection of the base portion 12 with the track 18. As may be seen in FIG. 1, the base portion 12 fits under the track 18.

The ease with which the race course 10 may be assembled and disassembled should be understood. Simply by placing the lower end of the post 16 in the receptacle 14 which holds it on the base 12 and fitting the upper end of the post 16 with a projection 19 depending from the underside of the track 18, the race track 18 is extended upwardly and into its final useful position. The end 28 of the track 18 is pushed into the slots 26 of the upwardly projecting walls or fences 24 to complete the set up. Such an arrangement is easily the simplest to assemble of all toy automobile racing courses.

While there has been shown and described a preferred embodiment of the invention, it is to be understood that various other adaptations and modifications may be made within the spirit and scope of the invention. It is thus intended that the invention be limited in scope only by the appended claims.

What is claimed is:

1. A toy vehicle course comprising:

a spiral track capable of relaxing into an essentially collapsed position;

means for biasing the track to act as a spring having an extended taut position;

means for holding the track in an extended position so that one end of the track is higher than the other end; and means at the higher end of the track for reversing the direction of a toy vehicle traveling thereon including an end section of track having first and second wall means for guiding the vehicle in the end section and gradually inclined portion means for directing the vehicle back down the track from the higher end to the other end of the track.

2. A toy vehicle course comprising:

a spiral track capable of relaxing into an essentially collapsed position;

means for biasing the track to act as a spring having an extended taut position;

means for holding the track in an extended position so that one end of the track is higher than the other end; and means at one end of the track for reversing the direction of a toy vehicle traveling thereon including an end section of track formed into a tear-drop shape, a first wall surrounding the end section, a second wall for diverting a vehicle to one side of the end section to cause such a vehicle to travel along the first wall, the end section of track having a gradually inclined portion positioned so that a vehicle traveling along the first wall is brought to a level such that it passes over the second wall.

3. A toy vehicle course comprising:

a spiral track having two ends;

means for suspending one end of the track above the other end so that the track descends unformly from the one end to the other end; and means positioned at the one end of the track for reversing the direction of a toy vehicle traveling on the track including an end section of track having first and second wall means for guiding the vehicle in the end section and gradually inclined portion means for directing the vehicle back down the track from the one to the other end.

4. A toy vehicle course comprising:

a spiral track having two ends;

means for suspending one end of the track above the other end so that the track descends uniformly from the one end to the other end; and means positioned at the one end of the track for reversing the direction of a toy vehicle traveling on the track including an end section of track formed into a tear-drop shape, a first wall surrounding the end section, a second wall for diverting a vehicle to one side of the end section to cause such a vehicle to travel along th first wall, the end section of track hving a gradually inclined portion positioned so that a vehicle traveing along the first wall is brought to a level such that it passes over the second wall.

5. A reversing mechanism for a toy vehicle comprising:

an end section of track formed into a tear-drop shape;

a first wall surrounding the end section; and a second wall for diverting a vehicle to one side of the end section to cause such a vehicle to travel along the first wall, the end section of track having a gradually inclined portion positioned so that a vehicle traveling along the first wall is brought to a level such that it passes over the second wall.

* * * * *